United States Patent [19]

Nakada

[11] 4,153,394

[45] May 8, 1979

[54] FUEL PUMP

[75] Inventor: Takashi Nakada, Sowa, Japan

[73] Assignee: Kyosan Denki Kabushiki Kaisha, Tokyo, Japan

[21] Appl. No.: 832,964

[22] Filed: Sep. 14, 1977

[30] Foreign Application Priority Data

Feb. 28, 1977 [JP] Japan ..... 52-21124

[51] Int. Cl.[2] ..... F04B 45/04

[52] U.S. Cl. ..... 417/571; 417/471

[58] Field of Search ..... 417/471, 540, 571, 413; 92/97, 98

[56] References Cited

U.S. PATENT DOCUMENTS

| | | | |
|---|---|---|---|
| 3,200,758 | 8/1965 | Grabiel | 417/471 |
| 3,294,240 | 12/1966 | Korte | 417/571 |
| 3,304,880 | 2/1967 | Gold et al. | 417/471 |
| 3,362,341 | 1/1968 | Quatredeniers et al. | 417/571 |
| 3,364,869 | 1/1968 | Toschkoff | 417/540 |
| 3,364,870 | 1/1968 | Quatredeniers et al. | 417/413 |
| 3,635,598 | 1/1972 | Sieper | 417/471 |
| 3,811,803 | 5/1974 | Frohberg | 417/571 |
| 3,912,423 | 10/1975 | Pfabe | 417/471 |

*Primary Examiner*—William L. Freeh

*Attorney, Agent, or Firm*—Blanchard, Flynn, Thiel, Boutell & Tanis

[57] ABSTRACT

A fuel pump comprises an outer casing, which is made by drawing a steel sheet, caulkedly fitted to a diecast lower body. The outer casing is constricted in three stages. The second stage contains a seal-receiving flange at the open-side end of a cup-shaped inlet chamber shell, so that the inlet chamber shell contacts the inside surface of the outer casing. Also, the inlet chamber shell is brazed to the inside of the top of the outer casing for the purpose of rust prevention. Ribs are projected on the top of the outer casing to decrease its vibration and noise.

8 Claims, 5 Drawing Figures

FUEL PUMP

FIELD OF THE INVENTION

This invention relates to a diaphragm-type fuel pump for internal combustion engines. More particularly, it relates to a fuel pump whose casing is formed by drawing a thin metal sheet.

BACKGROUND OF THE INVENTION

An internal combustion engine has a fuel pump to supply fuel from the fuel tank to the carburetor.

The fuel pump of diaphragm type is most commonly used since it has a pressure regulating function.

Automotive internal combustion engines have been strongly required to decrease the weight and size of their fuel pumps. To comply with such requirement, various types of fuel pumps, casings of which are made by drawing steel sheet, have recently been proposed. In the United States and some other countries, the fuel pumps comprising steel sheet casings are already in popular use.

This type of fuel pump usually comprises a lower body made of diecasting and a steel sheet casing caukedly fitted thereto. The steel sheet casing and its internal structure are variously designed to form an intake, exhaust and pump chamber therein.

An object of this invention is to provide an improved fuel pump comprising a metal sheet casing.

Another object of this invention is provide a fuel pump with an intake and exhaust chamber of adequate capacities.

Still another object of this invention is to provide a fuel pump that is easy to assemble.

Yet another object of this invention is to provide a structure that decreases the vibration noise emitted by the fuel pump.

DETAILED DESCRIPTION

Figure 1:
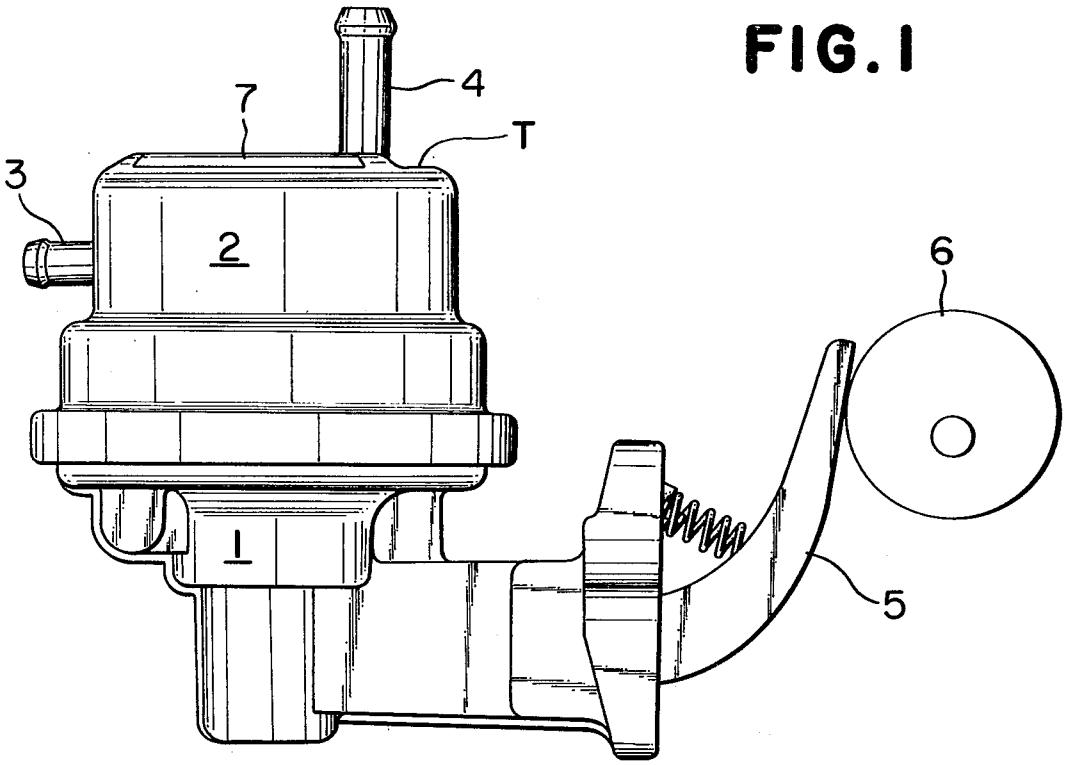
FIG. 1 is a front view of a fuel pump embodying this invention.
Figure 2:
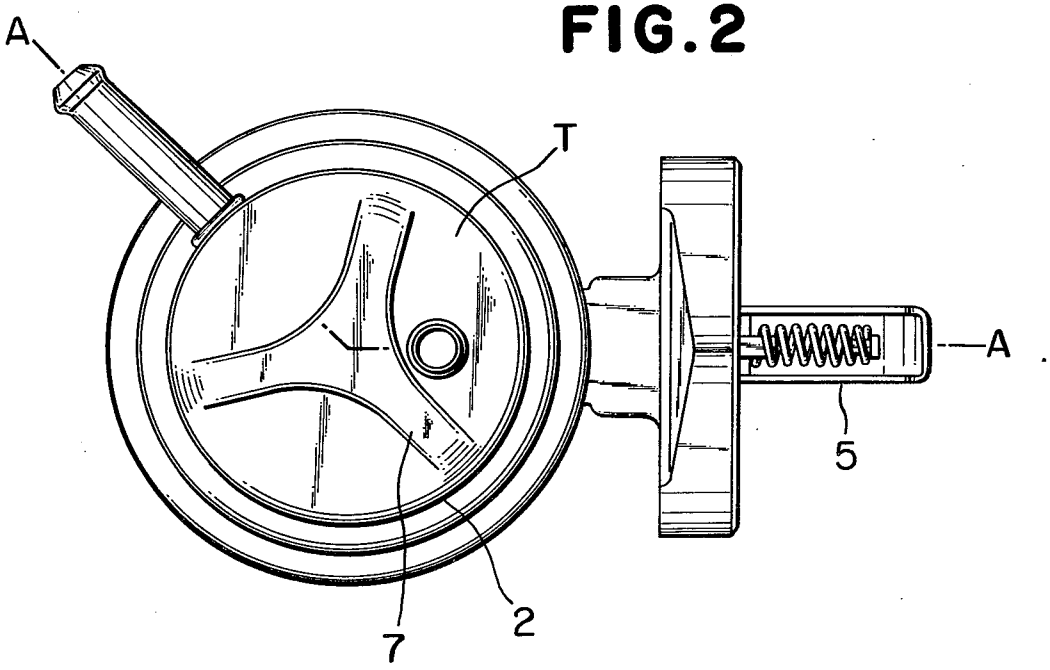
FIG. 2 is a plan view of the fuel pump shown in FIG. 1.

Referring first to FIGS. 1 and 2, an embodiment of this invention will be described. A fuel pump according to this invention comprises a diecast, thick-walled lower body 1 and an outer casing 2 made of metal sheet that is mounted and caulked thereon. The outer casing 2 is fitted with a fuel inlet pipe 3 and an outlet pipe 4. The lower body 1 carries a rocker arm 5 that is reciprocated by a cam 6. The outer casing 2 is commonly made of steel sheet, but it may also be made of aluminum alloy or other metals.

On the flat top T of the outer casing 2 are formed three ribs 7 radiating from the center to the edge. These ribs 7, made by press-forming, project above the outer casing 2.

A fuel pump having a steel sheet casing produces greater noise than one with a cast casing, because the casing itself, made of thin steel sheet, deforms and vibrates to generate noises.

According to this invention, however, the ribs 7 formed on the top T increases the rigidity thereof. Consequently, its deformation is small as compared with a round flat top, thus increasing the frequency of vibration and decreasing the noise of vibration.

Since the top T deforms most at the center, it is most desirable to form the ribs 7 radially from the center to the edge. The structure of the ribs 7 is not limited to the one illustrated, but other structures that increase the rigidity of the top T are adoptable, too.

Figure 3:
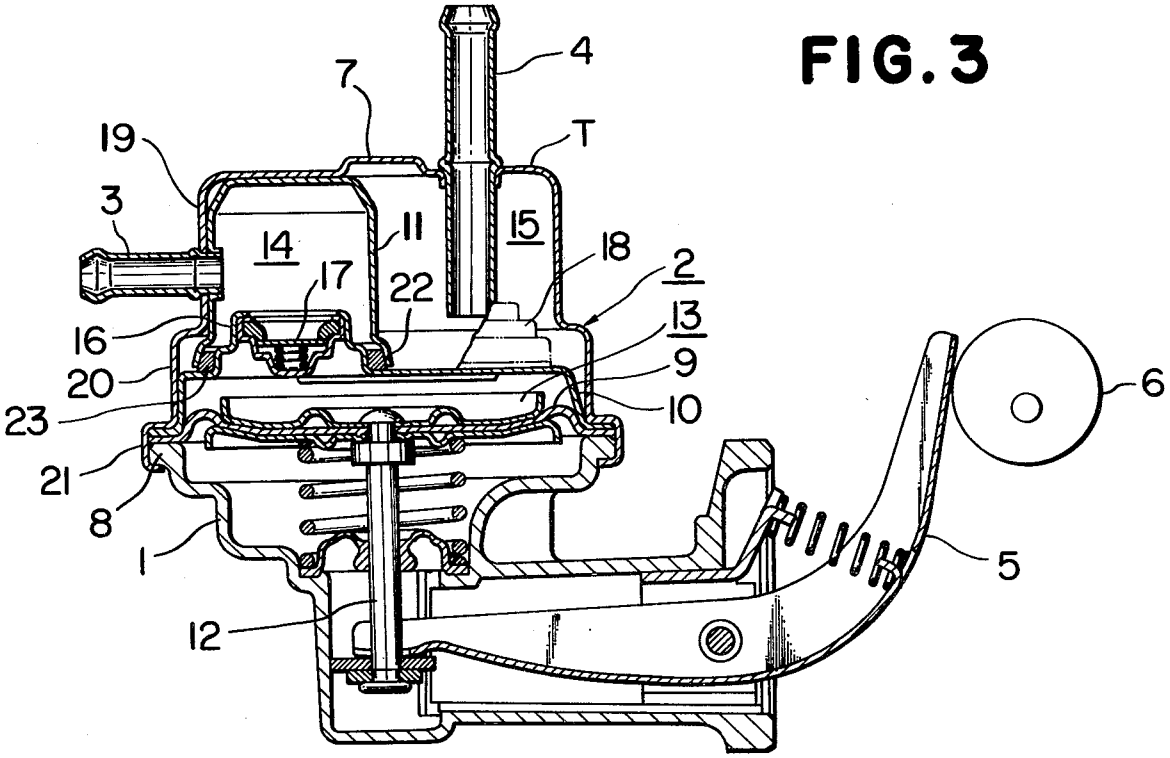
FIG. 3 is a cross-sectional view taken along the line A—A of FIG. 2.

Referring now to FIG. 3, the lower body 1 has a flange 8 along the edge thereof, and the outer casing 2 is caulkedly fitted thereto. The outer casing 2 contains a diaphragm 9, a separator plate 10 and an inlet chamber shell 11. The diaphragm 9 is reciprocated by the rocker arm 5 through a pull rod 12. Its edge is placed on the flange 8 and caulkedly fixed by the outer casing 2 together with the edge of the separator plate 10.

The separator plate 10 is made by forming thin metal sheet, preferably steel sheet. It defines a pump chamber 13 in conjunction with the diaphragm 9, and an inlet chamber 14 and outlet chamber 15 in conjunction with the outer casing 2.

The separator plate 10 has a cylindrically projecting valve holding section 16 that is formed by drawing. In the valve holding section 16 are press-fitted an inlet valve 17 and an outlet valve 18.

The outer casing 2 is constricted in three stages. Namely, a first cylindrical section 19, a second cylindrical section 20 and a third cylindrical section 21 are formed by drawing from the top. The edge of its lower end is caulkedly fixed to the flange 8 of the lower body 1. The cylindrical sections 19, 20 and 21 have increasingly larger inside diameters progressing downwardly.

The inlet chamber shell 11 is made by drawing a thin metal sheet, preferably a steel sheet, into the shape of a cup. A seal receiver 22 is formed along the edge of the lower open end. Formed by drawing, the seal receiver 22 flares out.

The inlet chamber shell 11 is positioned in contact with the inside sidewall of the first cylindrical section 19 of the outer casing 2. Since the seal receiver 22 is located in the second cylindrical section 20, the inlet chamber shell 11 can be brought into contact with the sidewall of the first cylindrical section 19 without hindrance. The seal receiver 22 carries a seal 23 that is positioned around the valve holding section 16 and pressed against the separator plate 10 by the outer casing 2. The inlet chamber shell 11 forms the inlet chamber 14 inside thereof, and the seal 23 seals the space between the inlet chamber 14 and the outlet chamber 15.

The inlet chamber pipe 3 opens into the inlet chamber 14, passing transversely through the sidewall of the first cylindrical section 19 and the sidewall of the inlet chamber shell 11 at these points of contact. The outlet pipe 4 opens into the outlet chamber 15, passing through the top T of the outer casing 2.

In designing this type of fuel pump, it is desirable to increase the capacities of the inlet chamber 14 and outlet chamber 15 so as to weaken the influence of the pulsation and inertia of fuel flow. It is also necessary to design such structure as will not restrict the provision of the inlet pipe 3 and outlet pipe 4.

According to this invention, the inlet pipe 3 can be provided easily since the inlet chamber shell 11 is brought into contact with the first cylindrical section 19. Even if the capacity of the inlet chamber 14 is increased to some extent, it will not impede the provision of the inlet pipe 3 and outlet pipe 4.

Figure 4:
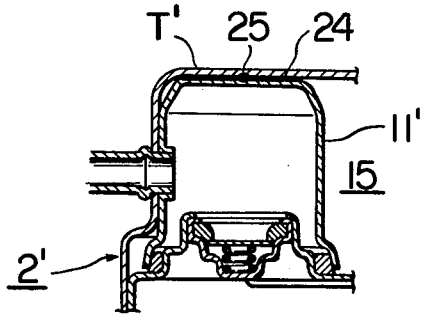
FIG. 4 is a partly cross-sectional view of another embodiment of this invention.

In FIG. 4, an inlet chamber shell 11' is fixed to the under side of the top T' of an outer casing 2' by brazing 24 which extends over the full contact area between the shell 11' and the top 9'.

Usually in this type of fuel pump, air collecting in the upper portion of the outlet chamber 15 serves to prevent pulsation. But this air layer stays between the inlet chamber shell 11' and the under side of the top T' and produces rust on them. According to this invention, fixing of the inlet chamber shell 11'' to the under side of the top T' by brazing 24 not only prevents such rusting but also increases the rigidity of the top T' and thereby decreases noise due to vibration.

Spot-welding 25 of the inlet chamber shell 11' to the top T' prior to brazing facilities their positioning and increases brazing efficiency.

Figure 5:
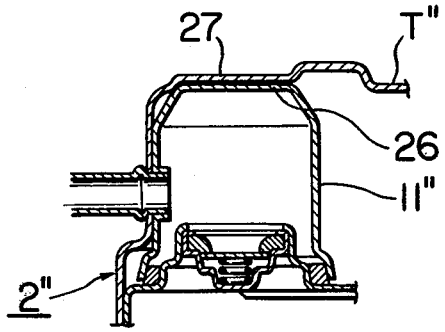
FIG. 5 is a partly cross-sectional view of still another embodiment of this invention.

FIG. 5 shows an embodiment in which a projection 26 formed on the inlet chamber shell 11'' is inserted in an indentation 27 formed in the top T''. This simplifies the positioning process as compared with said spot-welding. The projection 26 and indentation 27 are formed when drawing the inlet chamber shell 11'' and outer casing 2'' without requiring any additional process.

The embodiments of the invention in which an exclusive property or priviledge is claimed are defined as follows:

1. In a diaphragm-type fuel pump, including a thick-walled body having an opening therein, a pumping diaphragm extending across and closing said opening, a cup-shaped outer casing positioned over said diaphragm and connected to said body, said outer casing being formed from a thin metal sheet and having an end wall spaced a substantially distance from said diaphragm, said outer casing having three axially-spaced sections with a first said section being disposed directly adjacent said end wall and a second said section being cylindrical and disposed axially between said first section and the third said section, said third section being cylindrical and defined at the mouth of said outer casing and connected to said body, said third section having a diameter greater than said second section, said second section having a cross-sectional area greater than said first section, a separator positioned within and extending diametrically across said outer casing, said separator being positioned axially between said end wall and said diaphragm and being spaced from said diaphragm to define a pumping chamber therebetween, said separator and said diaphragm having the peripheral edges thereof fixedly interposed between said body and said outer casing within said third cylindrical section, said separator having cylindrically projecting inlet and outlet valve holding sections formed therein and projecting axially of said separator toward said end wall, inlet and outlet valve means respectively mounted within said inlet and outlet valve holding sections, means disposed within the compartment defined within said outer casing between said end wall and said separator for dividing said compartment into inlet and outlet chambers which respectively communicate with the inlet and outlet valve means, an inlet pipe projecting through the outer casing for communication with the inlet chamber, and an outlet pipe connected to the outer casing for communication with the outlet chamber, comprising the improvement wherein the first section of said outer casing is cylindrical and has a diameter less than said second section, all of said cylindrical casing sections being coaxially aligned, the dividing means being a substantially cylindrical cup-shaped shell formed from a thin metal sheet, said shell defining said inlet chamber in the interior thereof, said shell being closed at one end by a base wall which is disposed in engagement with the end wall of said outer casing, said shell at its open free and having an outwardly flared flange positioned in surrounding relationship to the inlet valve holding section on said separator, a seal positioned within said flared flange in surrounding and sealing engagement with said inlet valve holding section, said flared flange on said shell being positioned within said second cylindrical section, said shell being positioned sidewardly within said outer casing so that the cylindrical sidewall of said shell is maintained in contact with the inside surface of the cylindrical sidewall defining said first cylindrical section, and said inlet pipe as disposed exteriorly of said outer casing extending transversely relative to the cylindrical sidewall defining said first cylindrical section, said inlet pipe projecting transversely through the cylindrical sidewalls of said shell and said first cylindrical section at their region of contact for direct communication with said inlet chamber.

2. A fuel pump according to claim 1, wherein said first cylindrical section of said outer casing has an axial length which is substantially greater than the axial length of either said second and third cylindrical sections, said shell having an axial length greater than that of said first cylindrical section so that the base wall of said shell engages the end wall of said outer casing while the flared flange at the free end of said shell is positioned within the region surrounded by said second cylindrical section.

3. A fuel pump according to claim 1, wherein the base wall of said shell is braised to the inside surface of the end wall of said outer casing over substantially the complete surface thereof for rust proofing this region of contact.

4. A diaphragm-type fuel pump according to claim 3, in which the inlet chamber shell is fitted in an indentation formed in the end wall of the outer casing and then brazed thereto.

5. A diaphragm-type fuel pump according to claim 3, in which the chamber shell is spot-welded to the end wall of the outer casing and then brazed thereto.

6. A fuel pump according to claim 3, wherein the end wall of said outer casing is substantially flat and has a plurality of outwardly projecting ribs formed therein for minimizing noise generated by the outer casing.

7. A fuel pump according to claim 1, wherein the end wall of said outer shell is substantially flat, and in which said end wall has a plurality of outwardly projecting ribs formed therein for minimizing noise generated by the outer casing.

8. A fuel pump according to claim 7, in which said ribs extend radially of said end wall from the center thereof.

* * * * *

UNITED STATES PATENT AND TRADEMARK OFFICE

CERTIFICATE OF CORRECTION

PATENT NO. : 4 153 394

DATED May 8, 1979

INVENTOR(S) : Takashi Nakada

It is certified that error appears in the above-identified patent and that said Letters Patent are hereby corrected as shown below:

Column 3, line 38; change "substantially" to ---substantial---.

Column 4, line 13; change "and" to ---end---.

Column 4, line 51; after "the" (first occurrence) insert ---inlet---.

Signed and Sealed this

*Twenty-eighth* Day of *August 1979*

[SEAL]

*Attest:*

*Attesting Officer*

LUTRELLE F. PARKER

*Acting Commissioner of Patents and Trademarks*